US006050485A

United States Patent [19]

Brito

[11] Patent Number: 6,050,485

[45] Date of Patent: Apr. 18, 2000

[54] APPARATUS FOR COUNTING RECYCLABLE RETURNABLE ITEM HAVING AN AIR TIGHT TRAP DOOR MECHANISM

[76] Inventor: Darryl E. Brito, 31 George St., Plymouth, Mass. 02360

[21] Appl. No.: 08/972,862

[22] Filed: Nov. 18, 1997

[51] Int. Cl.[7] ..... G06M 1/00

[52] U.S. Cl. ..... 235/91 R; 232/44; 232/47; 235/98 B; 235/98 C

[58] Field of Search ..... 235/91 R, 98 C, 235/98 B, 28, 21; 232/44, 47

[56] References Cited

U.S. PATENT DOCUMENTS

| | | | |
|---|---|---|---|
| 27,466 | 3/1860 | North . | |
| 170,141 | 11/1875 | Wilcoxson . | |
| D. 364,567 | 11/1995 | Dancel et al. | D9/436 |
| 1,322,522 | 11/1919 | Bixon . | |
| 2,023,574 | 12/1935 | Cohn | 235/98 |
| 2,465,215 | 3/1949 | Fergnani | 250/41.5 |
| 4,395,625 | 7/1983 | Schutt | 235/98 R |
| 4,731,802 | 3/1988 | Magnusson et al. | 377/6 |
| 4,821,903 | 4/1989 | Hayes | 220/1 T |
| 4,834,262 | 5/1989 | Reed | 220/404 |
| 5,085,342 | 2/1992 | Strawder | 220/404 |
| 5,203,618 | 4/1993 | Oshall | 312/290 |
| 5,560,512 | 10/1996 | Hahn | 220/334 |

*Primary Examiner*—Donald Hajec
*Assistant Examiner*—Daniel S. Felten
*Attorney, Agent, or Firm*—Louis J. Franco

[57] ABSTRACT

An apparatus for counting recyclable, returnable items is provided. The apparatus includes a housing with an opening through which recyclable, returnable items ("returnables") are received for deposit into a receptacle located below the housing. As returnables are received through the opening in the housing, the returnables must strike a trap door lever before passing to the receptacle. The lever trap door is pivotally mounted to the housing and moves between an obstructing position and a non-obstructing position. The obstructing position is such that the trap door lever at obstructs and forms an air-tight seal with the opening in the housing so that returnables destined for the receptacle must strike and displace it into its non-obstructing position to allow the trap door returnable to pass. The lever is biased into its obstructing position by a lever biasing means so that after returnables have passed by the trap door lever, the trap door lever returns to its obstructing position. Included on the apparatus is a counting meter with a numeric display which is connected to the trap door lever such that the displacement of the trap door lever each time a returnable is deposited through the opening in the housing causes the counting meter to register the movement and advance its numeric display by the value "1."

19 Claims, 12 Drawing Sheets

APPARATUS FOR COUNTING RECYCLABLE RETURNABLE ITEM HAVING AN AIR TIGHT TRAP DOOR MECHANISM

FIELD OF THE INVENTION

This invention relates generally to the collection and redemption of recyclable cans and bottles, and more particularly to an apparatus which tallies and displays the total number of recyclable items deposited into a receptacle.

BACKGROUND OF THE INVENTION

The recycling of cans, bottles, paper, plastic, cardboard and other items has steadily increased over the past 20 to 30 years. Many states encourage the recycling of such items, particularly beverage containers, by requiring the consumer to pay a container deposit at the time of purchase. These deposits are returned to the consumer when the container is returned to a redemption center. Some states require the recycling of such items by law without the incentive provided by the container deposit system in force in many states.

It is a reasonable proposition that the bulk of items sold in so called returnable containers are sold to consumers for use in the home. It has become common place for members of households to collect, separate, count and return these returnable containers to receive the return of the deposit paid at purchase. Common methods of carrying out this task include providing separate receptacles for cans, plastic bottles, and glass bottles. Sometimes separate receptacles are even provided for glass bottles according to the color of the glass: green, brown or clear, for example. It is also reasonable to suppose that most persons do not derive pleasure from performing this often time consuming task; most view it as their duty to help preserve the environment or as a means of cutting costs by receiving the return of the container deposit or both. When returnable containers are brought to redemption centers, it is often the responsibility of the consumer to know the quantity of items being returned. Even in those instances where this is not the case, such as when returnables are deposited into centrally located machines which receive, count, and compress the returnable containers, and then release the corresponding amount of money to the consumer, most persons tend to count their returnables before making the trip to redeem their containers.

There are no known devices for use in the home for assisting consumers with the mundane task of counting accumulated returnables.

The instant invention provides an apparatus which registers, tallies, and displays the total number of returnables entered into a receptacle for redemption and thereby eliminates the need of consumers to do so manually. For the purpose of this specification and the claims, all items such as cans, bottles, and other containers which this device is intended to count are referred to collectively as "returnables."

SUMMARY OF THE INVENTION

It is the principal object of this invention to provide an apparatus which registers, tallies, and displays the total number of returnables deposited into a receptacle for redemption.

It is a further object of this invention, by its performance of the principal object, to eliminate much of the displeasure of collecting and redeeming returnable containers by obviating the need for consumers to manually count the same, and even to introduce an element of fun and entertainment into the task.

It is still an additional object of the present invention to further encourage persons to recycle their returnable containers to protect and preserve the environment by rendering the job easier and more pleasurable.

The above and other objects are achieved by the present invention which, according to a first, preferred embodiment provides a housing having a returnable-receiving opening therein through which returnables are to be deposited into a receptacle disposed below the housing. The housing may be of any shape, but certain shapes are more advantageous than others. If the receptacle to be positioned below the housing is a standard kitchen or other garbage can, then a housing shaped to cover the open top of such a garbage can in the same manner the garbage can's own lid would is most desirable. If, however, the receptacle is to be a non-rigid structure such as a plastic garbage bag, then the housing will preferably have a perimeter which is substantially circular in shape to which the plastic garbage bag may be fastened in substantially air-tight fashion. In cases in which a non-rigid receptacle is to be used in combination with the device, the device cannot depend for its support above the floor or ground on the receptacle into which returnables are to be deposited; therefore, a means for elevating the housing over the receptacle must be provided and could include a free-standing framework which would allow the device to be moved to different locations or means for mounting the device to a wall or other structure either permanently or temporarily. The details of such supporting means are reserved for the detailed description.

Pivotally attached to the housing is a lever which is pivotable between a first, obstructing position in which it at least partially obstructs the returnable-receiving opening so that returnables deposited therethrough must strike and displace it, and a second, non-obstructing position in which returnables may pass by the lever and into the receptacle below. Acting on the lever is a means for biasing the lever into its first, obstructing position. Such means may include a torsion spring, a coil spring, a leaf spring, or another resilient or elastic member.

Also disposed on the housing is a counting meter for counting the number of returnable items deposited into the receptacle below. The counting meter registers and displays the total number of occasions on which the lever is displaced to the second, non-obstructing position. The activation of the counting meter to advance the display by "1" each time the lever is displaced is preferably achieved by direct mechanical contact with the lever or mechanical contact through some intermediate linkage, but the use of magnetic, electromagnetic, electromechanical, electrical, electronic, photonic, optoelectronic or other similar means will certainly occur to those of ordinary skill in the art and are deemed to be within the scope of this invention. It is even conceivable that one could employ a device which would directly detect the passing by of an object into the receptacle such as through the interruption of a beam or the like, thereby eliminating the need for the lever altogether, but such means are likely to be relatively expensive and would necessarily rely for their operation on a source of electrical power.

When the receptacle is full, or when a predetermined number of returnables have been deposited therein, the housing and the receptacle may be separated, the receptacle emptied or taken away, an empty receptacle joined with the housing, and the counting meter reset to read "0."

In the best mode of the invention contemplated by the inventor, the lever is in the form of a trap door which completely covers the returnable-receiving opening when in the first, obstructing position to prevent odors originating from returnables within the receptacle from diffusing to the atmosphere surrounding the device and the receptacle. Furthermore, the preferred counting meter is of the general type that is normally activated by one's thumb or finger and that is commonly available. These devices generally have a depressable button, a digital or other numeric display which displays the number of times the button has been depressed, and a reset button to bring the display reading back to zero. The counting meter is mounted onto the housing in a position that makes its display conveniently readable and its reset button reasonably accessible. The counting meter is also mounted in a location that facilitates simplicity in mechanically linking it to the lever such that the moving of the lever into its second, non-obstructing position causes the depression or activation of the button on the counting meter and permits that button to return to its normally non-depressed position each time the lever returns to its first, obstructing position.

Other objects, features, advantages and uses of this invention will occur to those skilled in the art and others from the following description of a preferred embodiment and the accompanying drawings.

DETAILED DESCRIPTION OF THE PREFERRED EMBODIMENT

Figure 1:
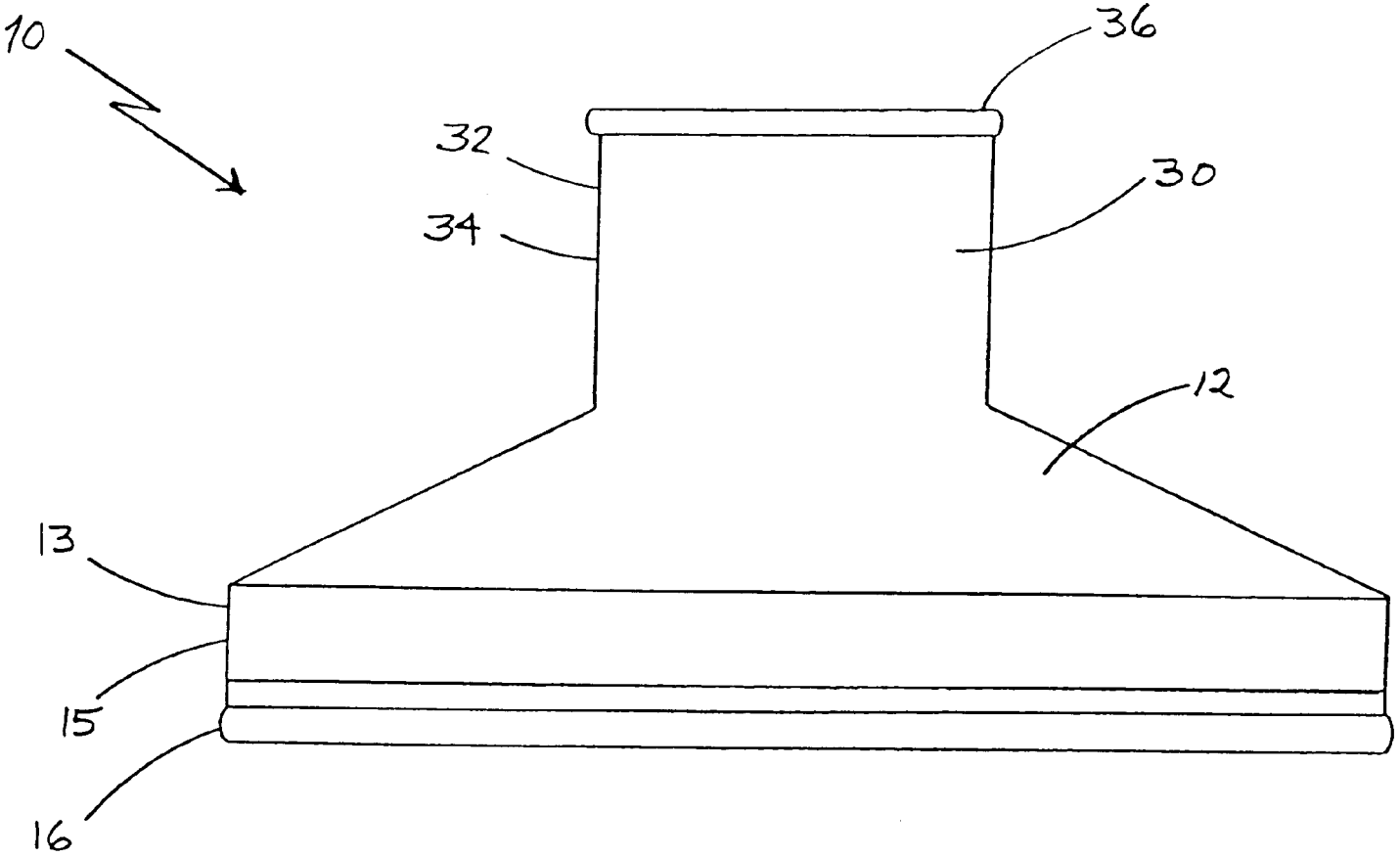
FIG. 1 is a side view depicting the exterior portion of the housing of the preferred embodiment.

There is shown in FIGS. 1 through 12 an apparatus for counting recyclable returnable items 10 according to a preferred embodiment of the present invention. Apparatus 10 comprises a housing 12 having a side wall 13, which has an inner surface 14 and an outer surface 15, and a top wall 17, which has an inner surface 18 and an outer surface 19. Included in housing 12, and extending through top wall 17 thereof, is returnable-receiving chute 30. Returnable receiving chute 30 has a chute side wall 32 and extends downwardly from an open top end 36 to a returnable receiving opening 38. Chute side wall 32 has inner and outer surfaces 33 and 34 respectively.

In the preferred embodiment, chute 30 extends above top wall 19 by an amount sufficient to permit its being grasped by a user to serve as a handle. In those instances in which top wall 19 is sloped downwardly as it extends outwardly, as is illustrated in FIGS. 1,2, 6–8, 11, and 12 chute 30 preferably extends below the area in which it is joined with top wall 19 to a depth sufficient to accommodate components to be described further in this description.

Figure 12:
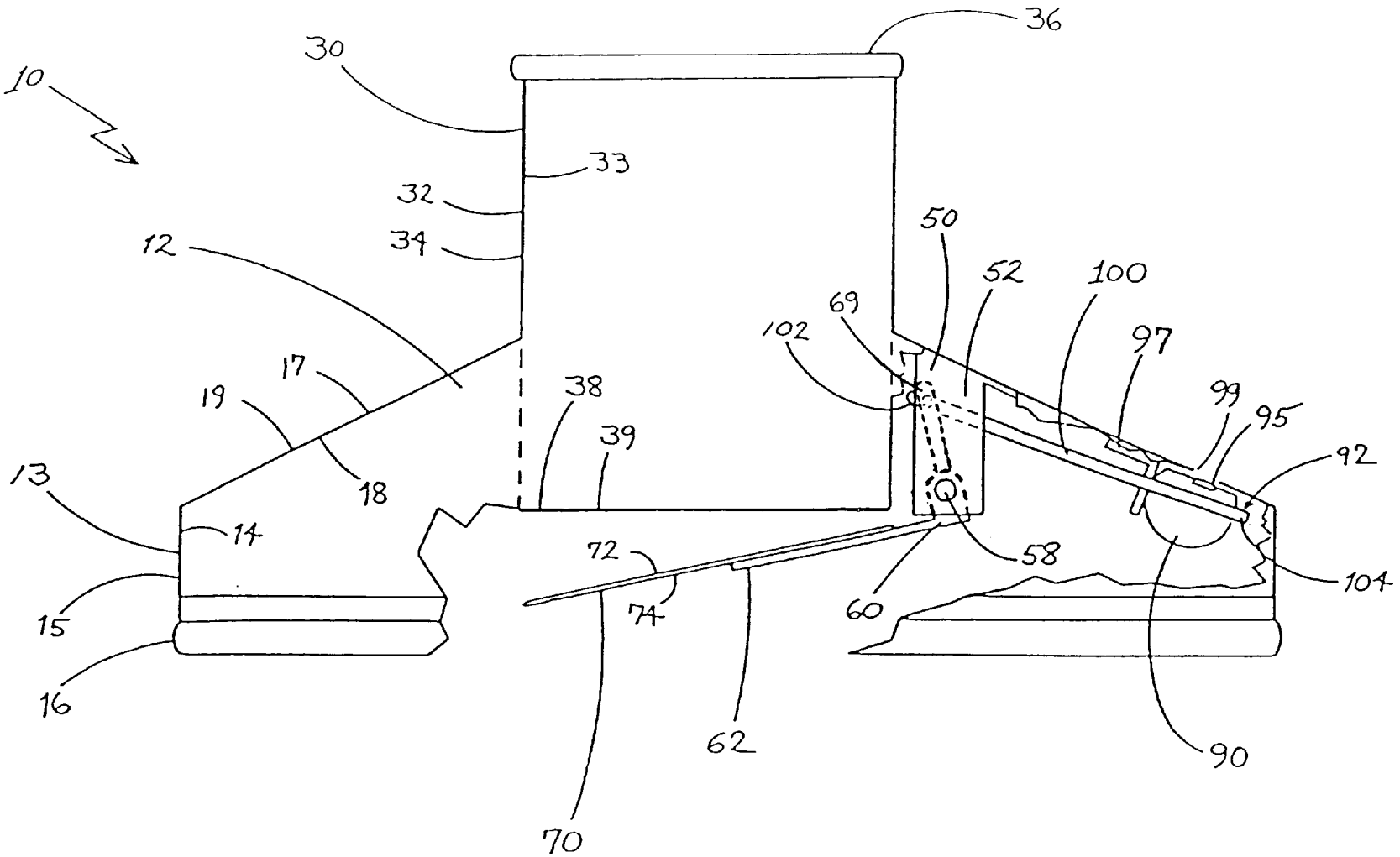
FIG. 12 is a partial cutaway side view of the housing, like that of FIG. 2, illustrating details of components disposed therein; most notably, in this view, the trap door lever mount is attached to the top wall inner surface of the housing.

Mounted to or integrally molded with housing 12, preferably on a portion of outer surface 34 of chute side wall 32 which extends below top wall inner surface 18 by an amount sufficient to accommodate the same, is trap door lever mount 50. Trap door lever mount 50 preferably comprises a pair of substantially parallel, spaced apart mount anchors; specifically, right-hand mount anchor 52 and left-hand mount anchor 54 (See FIG. 3). For added stability and durability, anchor stabilizer 55 may extend between, and be fixedly attached to or integrally molded with, mount anchors 52 and 54. Extending substantially perpendicularly from and between mount anchors 52 and 54 is rocker arm pivot axis 58. For reasons to become apparent, it is preferable but not essential that pivot axis 58 be fixed with respect to mount anchors 52 and 54. Furthermore, to facilitate ease of manufacture and to conserve material, rocker arm pivot axis 58 could be designed to be one in the same with anchor stabilizer 55. FIG. 12 illustrates the same basic configuration, with the same components, wherein lever mount 50 is attached to, and downwardly extends from, top wall inner surface 18.

Figure 2:
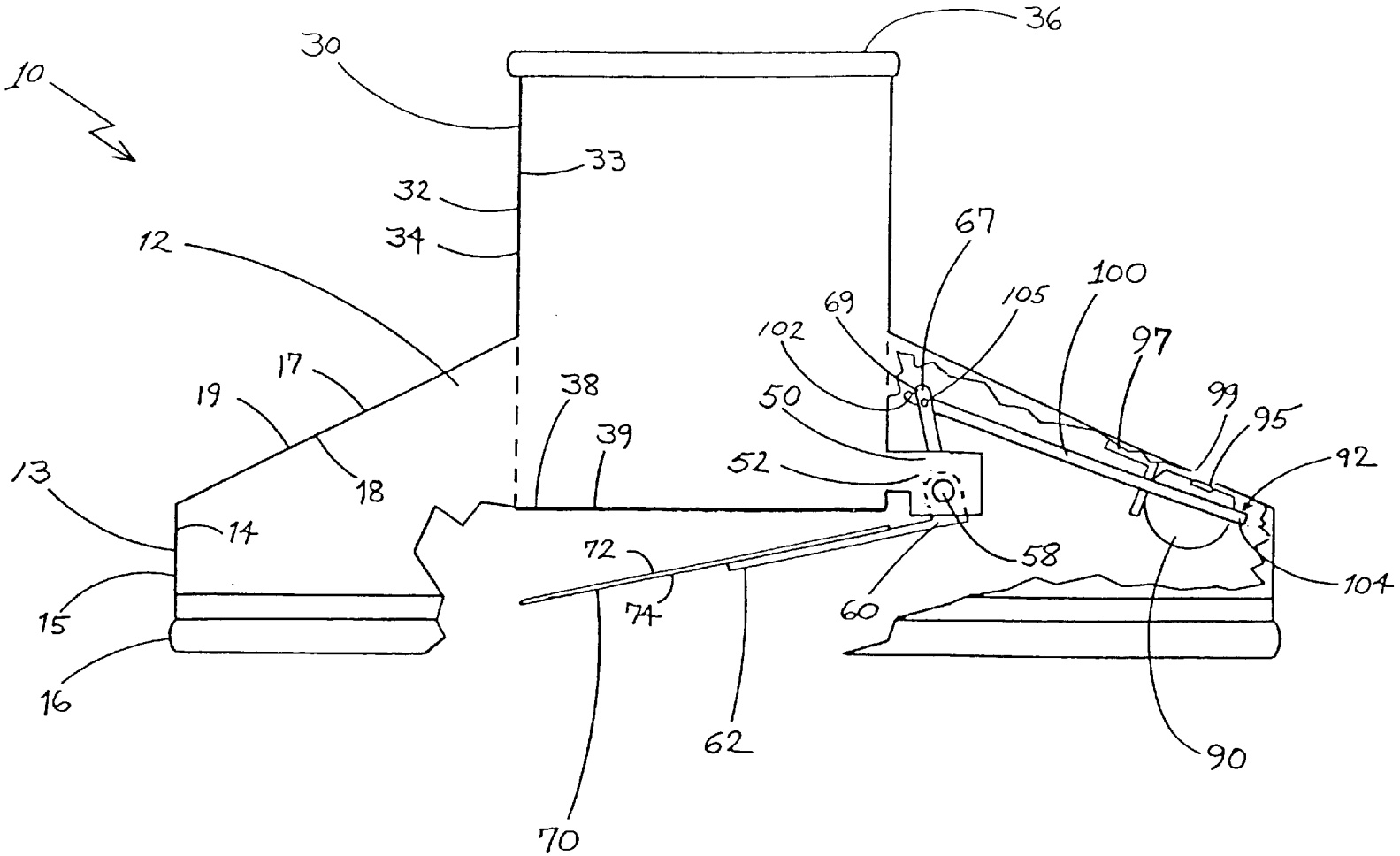
FIG. 2 shows a partial cutaway side view of the housing illustrating details of components disposed therein.
Figure 3:
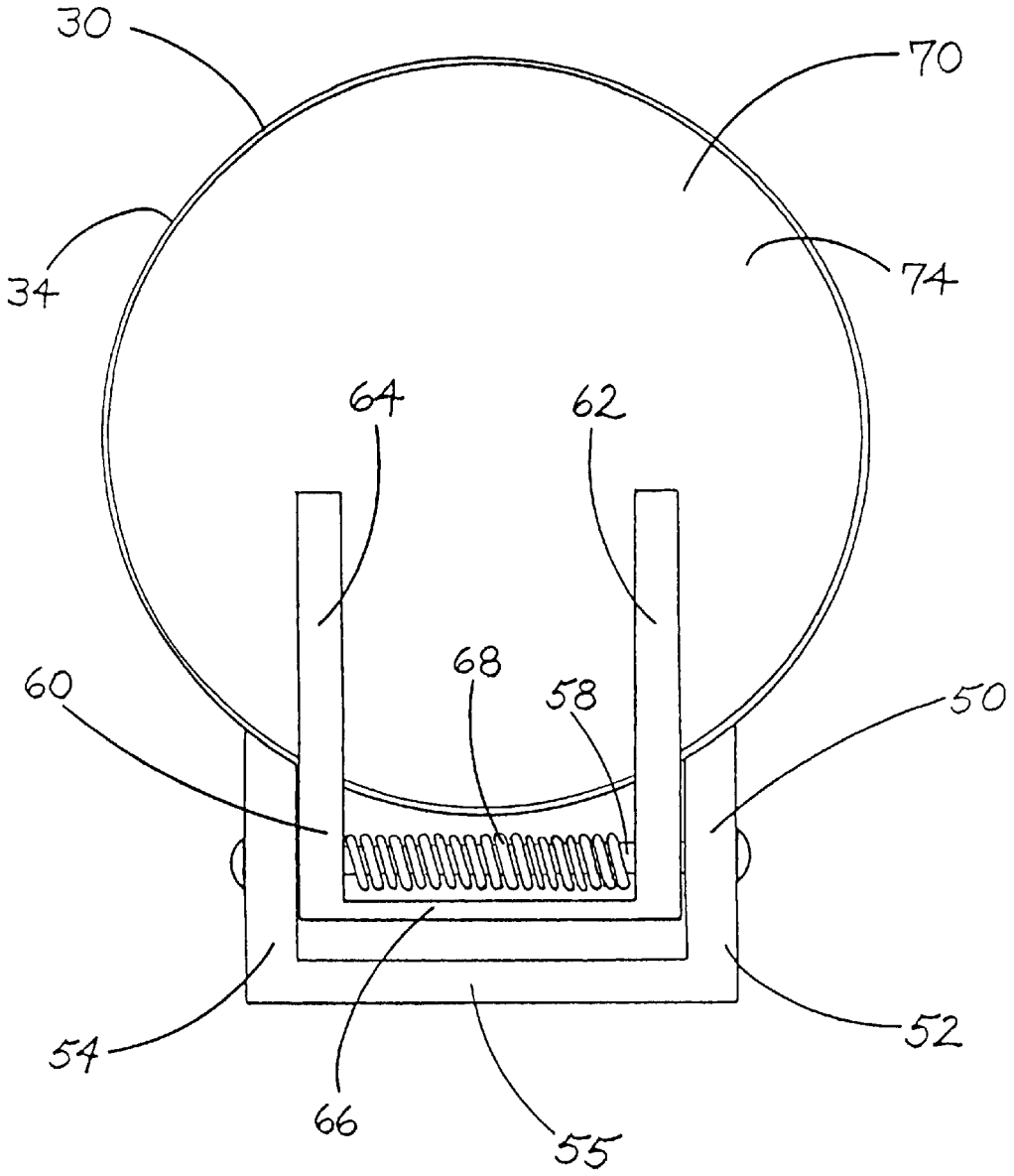
FIG. 3 is a bottom view of the trap door lever and returnable-receiving chute and shows details of how the trap door lever is pivotally mounted to the housing and biased into a first, obstructing (closed) position.
Figure 5:
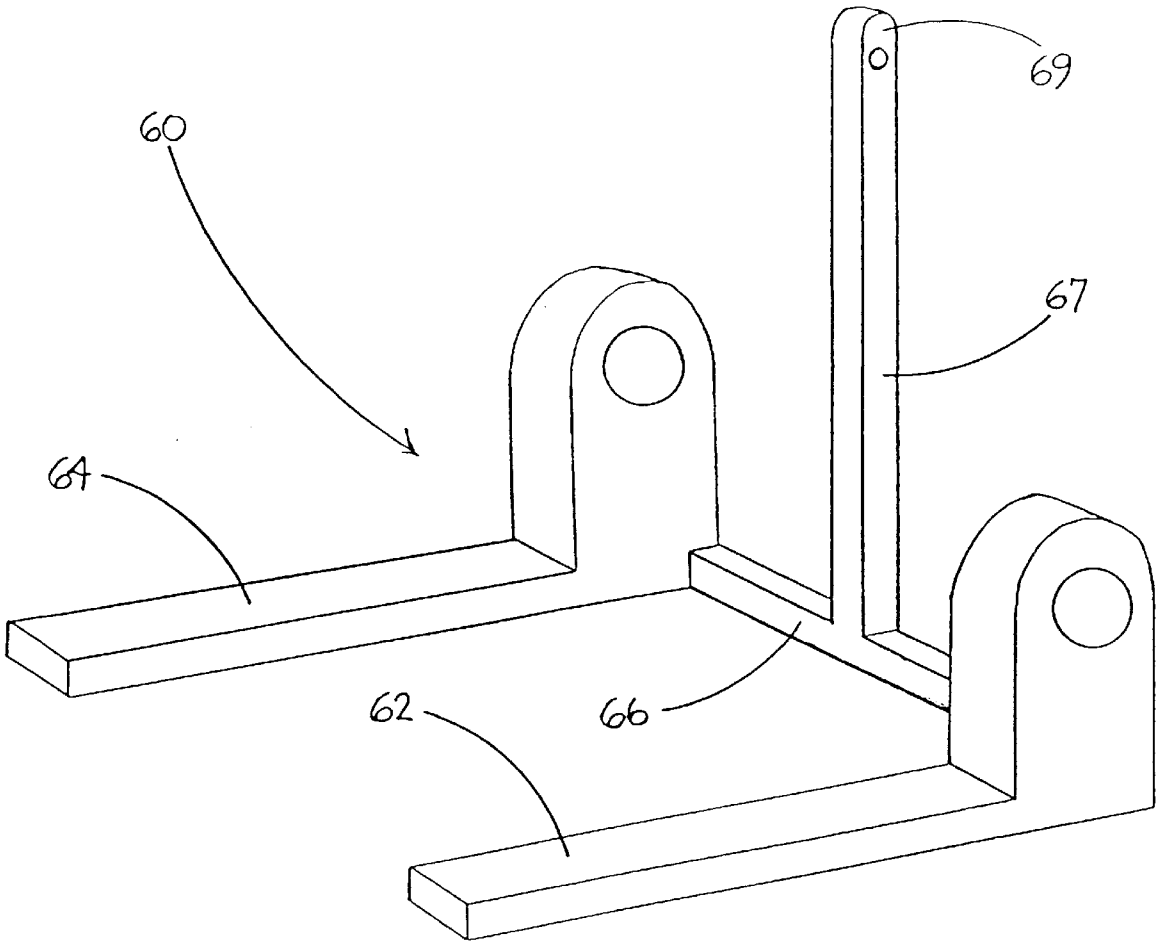
FIG. 5 is a top perspective view of the trap-door-lever rocker arm used to pivotally attach the trap door lever to the housing.

Pivotally disposed on rocker arm pivot axis 58 is trap-door-lever rocker arm 60 (FIGS. 2,3, and 5). Attached to or integrally molded with rocker arm 60 is trap door lever 70. Trap door lever 70 has a top surface 72 and a bottom surface 74. To provide strength and durability, it is preferable that rocker arm 60 comprise two fingers, right-hand finger 62 and left-hand finger 64, extending from points of pivotal attachment to rocker arm pivot axis 58 to distal end points of attachment with bottom surface 74. In any event, rocker arm 60 has at least one finger 62 or 64 extending from a point of pivotal attachment to pivot axis 58 to a distal end which is attached to lever 70. Similar to lever mount 50, fingers 62 and 64 of rocker arm 60 in the preferred embodiment are joined by rocker arm stabilizer 66. Rocker arm stabilizer 66 ensures that a fixed distance between fingers 62 and 64 is maintained and assists in preventing fingers 62 and 64 from pivoting about pivot axis 58 independently of one another which could cause trap door lever 70 to deviate from its intended path of motion, a consequence the undesirability of which will become apparent below.

Trap door lever 70 is of a size and shape to completely cover returnable-receiving opening 38 and is pivotable about pivot axis 58 between a first, obstructing position in which it substantially closes off returnable-receiving opening 38 and a second, non-obstructing position in which returnables may pass through returnable-receiving opening 38 and into a receptacle 200 located below housing 12. Trap door lever biasing means are provided for urging trap door lever 70 into its first, obstructing position. The preferred mechanism to facilitate these biasing means is a torsion spring 68 which is anchored at one end to either pivot axis 58 or rocker arm 60 and, at its other end, bears against the other of rocker arm 60 and pivot axis 58. Of course any number of mechanisms could be employed to urge trap door lever 70 into its first obstructing position including a coil spring, a leaf spring, an elastic or resilient member, magnets or even a counter weight disposed at or near rocker arm stabilizer 66, and all such alternatives and their functional equivalents are regarded as within the scope and contemplation of this invention.

Because returnables, even when they are washed out before storing for redemption, can sometimes be the source of disagreeable odors, it is desirable that the contact between trap door lever 70 and that portion of chute side wall 32 defining returnable-receiving opening 38 be as close to air tight as possible. To facilitate this feature, a resilient gasket 39 may be attached to chute side wall 32 at the perimeter of returnable-receiving opening 38.

As stated in the summary of the invention, it is the displacement of trap door lever 70 between its first, obstructing position and its second, non-obstructing position which is to be detected and registered. To accomplish this objective, a counting meter 90 is provided. Counting meter 90 is preferably mechanical in nature. More particularly, meter 90 has an advance button 92, a numeric display 95, and a reset button 98. Counting meters of this general type are so well known in and out of the art to which this invention pertains that explanations as to the functions of advance button 92, numeric display 95, and reset button 98 is all that is required for a full appreciation of the metering aspect of the invention. Numeric display 95 indicates the number of times advance button 92 has been depressed or activated since the last occasion on which reset button 98 was activated to return display 95 to a reading of "0." Each time advance button 92 is activated, the display advances the total count displayed by the value "1."

Counting meter 90 is preferably removably mounted to top wall inner surface 18 of housing 12 via meter mount 97 so that its numeric display 95 faces generally upward and is visible through a display window 99 provided in housing top wall 17. Removability of meter 90 is desirable in the event meter 90 should cease functioning; replacement of meter 90 is all that would be required as opposed to replacement of the entire apparatus 10.

Turning now to the meter drive means connecting counting meter 90 to trap door lever 70 such that the movement of the latter into its second, non-obstructing position causes meter 90 to register and indicate the occurrence of the event, extending generally upward from rocker arm 60, and attached to or integral therewith, is rocker arm coupling element 67 (FIGS. 2 and 5). Coupling element 67 extends from its point of connection with rocker arm 60 to its coupling end 69. Coupling element 67 moves rotationally about pivot axis 58 in tandem with the remainder of rocker arm 60. In accordance with basic geometric principles, the longer coupling element 67 is, the greater the arcuate distance its coupling end 69 will travel for any given angular displacement about pivot axis 58. Pivotally attached to coupling element 67, adjacent its coupling end 69, is meter arm 100, as illustrated in FIG. 1. Meter arm 100 has a first end 102 and a second end 104 and is joined with coupling element 69 at its first end 102 by pivot pin 105. At second end 104, meter arm 100 is attached to advance button 92. Depending on the length and flexibility of meter arm 100, the junction between second end 104 and button 92 may also have to be pivotal; this point is also dictated by simple geometric and engineering principles and therefore requires no further explanation.

It warrants stating that the mechanical details of the particular meter drive means disclosed herein is only a single example of numerous mechanical variations capable of achieving the same result, and that such alternatives will no doubt occur to those of ordinary skill in the art to which this invention pertains and are regarded as within the scope of this invention. Rotational ratcheting systems of the type used in pendulum driven clocks come to mind as one specific alternative. The essential feature of the meter and its drive means is that it respond to at least a portion of one cycle of motion of trap door lever 70 by counting and displaying the occurrence of the event. What is meant by a cycle of motion is the action of trap door lever 70 moving from its first, obstructing position to its second, non-obstructing position and back again to its original obstructing position. While the registering and displaying of the occurrence of this motion in the description above has focused on the first half of the cycle (i.e., the lever 70 moving from its first to its second position), there is no reason why the drive means cannot be arranged such that the return of lever 70 from its second to its first position is what is registered and displayed. However, the preferred choice of which motion to register was not entirely arbitrary with this inventor because, with the arrangement chosen, meter 90 will still register the deposit of a returnable item even if lever 70 should for some reason remain stuck in its second, non-obstructing position after the deposit of a returnable through apparatus 10. The opposite arrangement requires the return of lever 70 to its first position to register the deposit.

Figure 6:
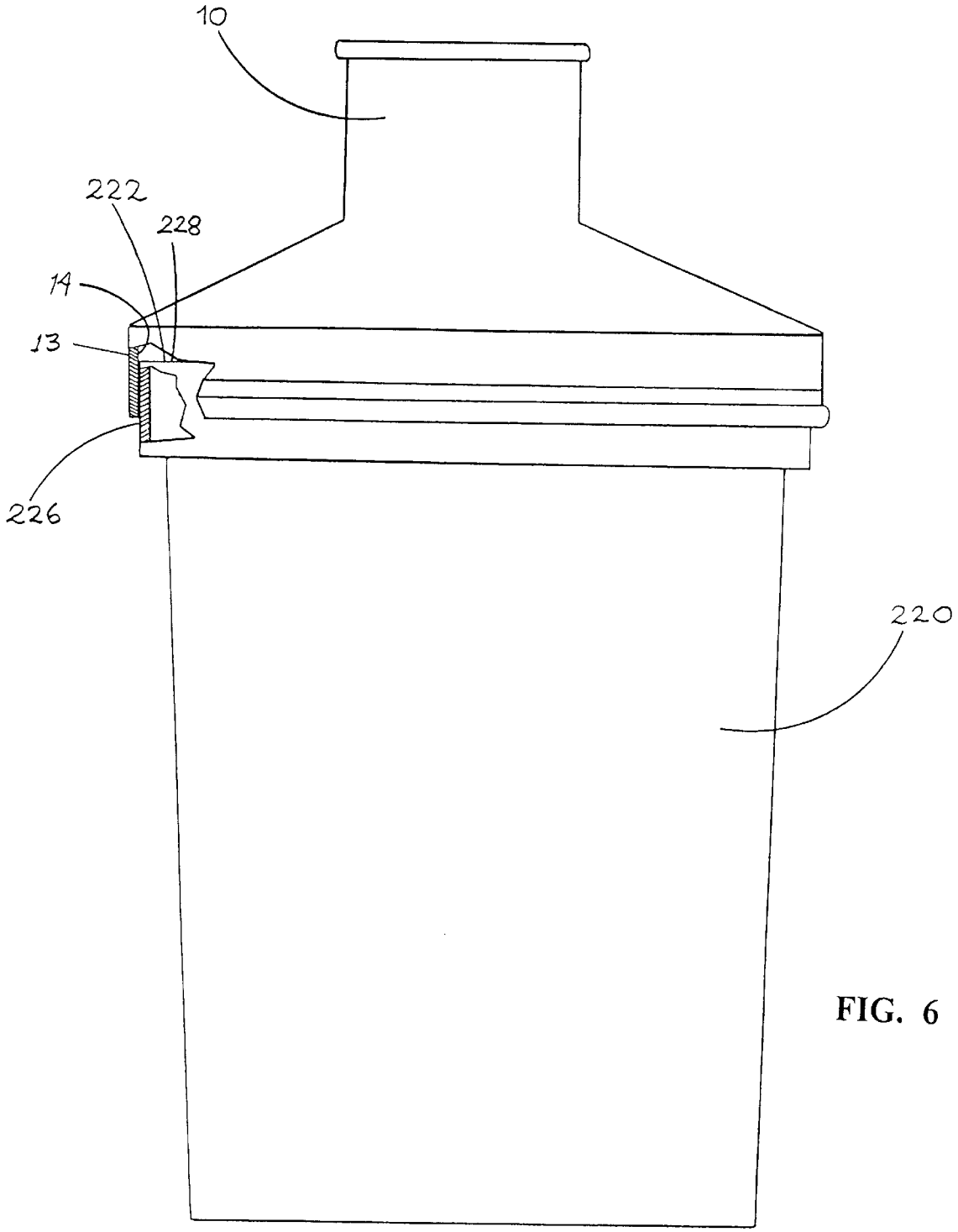
FIG. 6 illustrates a side view of the preferred embodiment of the apparatus mounted on, and supported by, a rigid, free standing returnable-item receptacle such as a garbage can.

As stated in the summary of invention, apparatus 10 may be adapted for use with any type receptacle such as a substantially rigid, free standing receptacle 220 like a garbage can or a non-rigid receptacle 240 requiring independent support such as a plastic or paper bag. In those instances where apparatus 10 is to be used in combination with a rigid, free standing receptacle 220, housing 12 can be constructed to fit over the upper rim 222 of such a receptacle in the same manner a garbage can's own lid would. In such circumstances, side wall inner surface 14 of housing side wall 13 would have to be substantially vertical for placement over and removable engagement with the outer perimeter 226 of the upper rim defining the open top 228 of receptacle 220. Furthermore, it is preferable that the removable engagement between side wall inner surface 14 and the outer perimeter 226 of the upper rim 222 of receptacle 220 be substantially air-tight so that odors originating from returnables within receptacle 220 are prevented from escaping through open top 228 of receptacle 220 and, more particularly, between perimeter 226 of upper rim 222 and side wall inner surface 14. Such an arrangement is illustrated in FIG. 6 with a cutaway view of a section of each of housing 10 and receptacle 220. A substantially rigid receptacle 220 such as that pictured in FIG. 6 serves to support apparatus 10 in position.

Where non-rigid receptacles such as bags are to be used with the device, an independent support means must be provided to support apparatus 10 above a surface such as the ground or floor with the non-rigid receptacle 240 disposed thereunder. By way of example, the inventor discloses one such independent support means in the form of wall bracket 300 illustrated in FIGS. 7 through 11.

Figure 7:
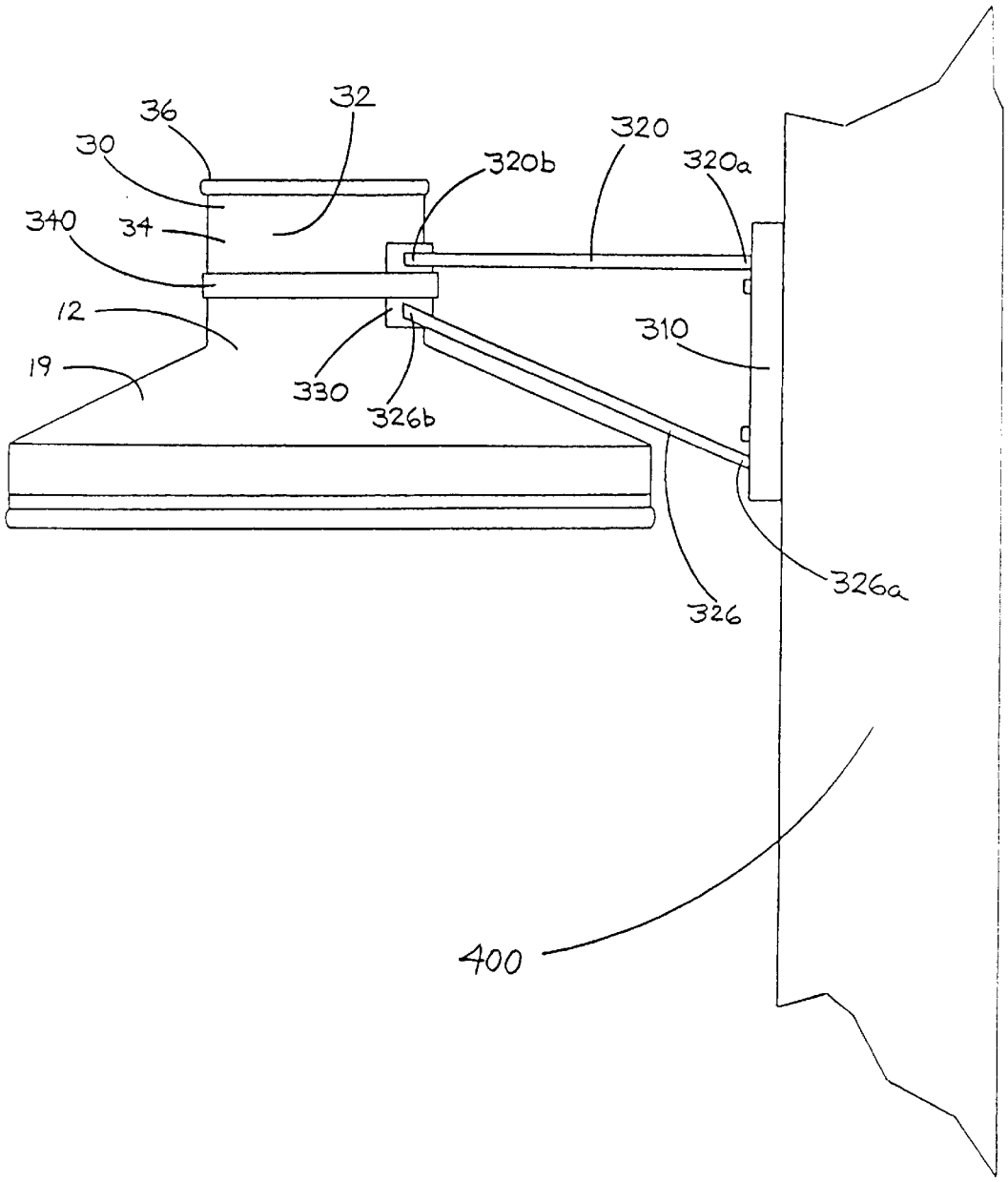
FIG. 7 illustrates a side view of the preferred embodiment of the apparatus secured to a wall with a wall bracket
Figure 8:
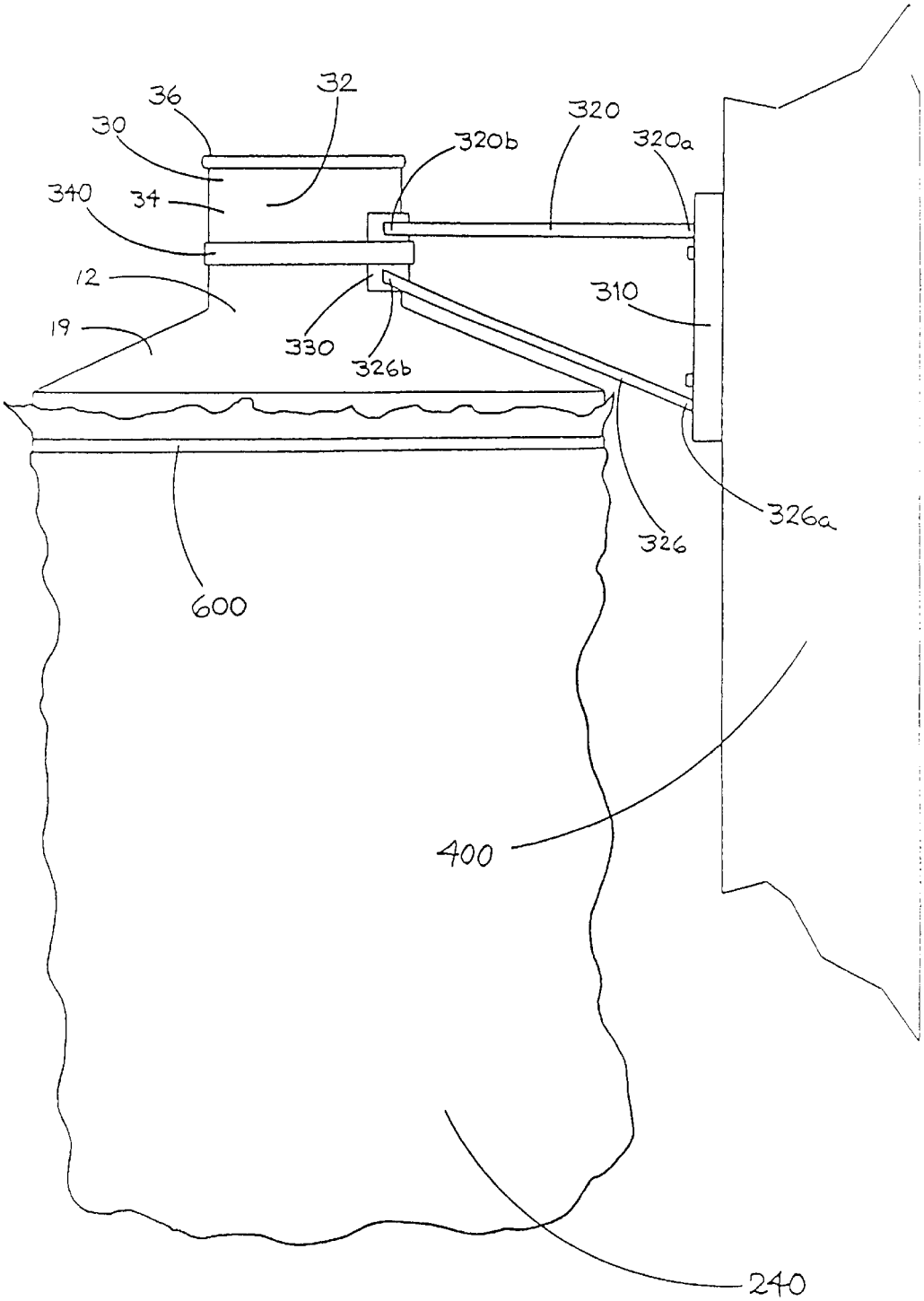
FIG. 8 illustrates a side view of the preferred embodiment of the apparatus secured to a wall with a wall bracket and supporting a non-rigid returnable-item receptacle such as a plastic garbage bag.
Figure 9:
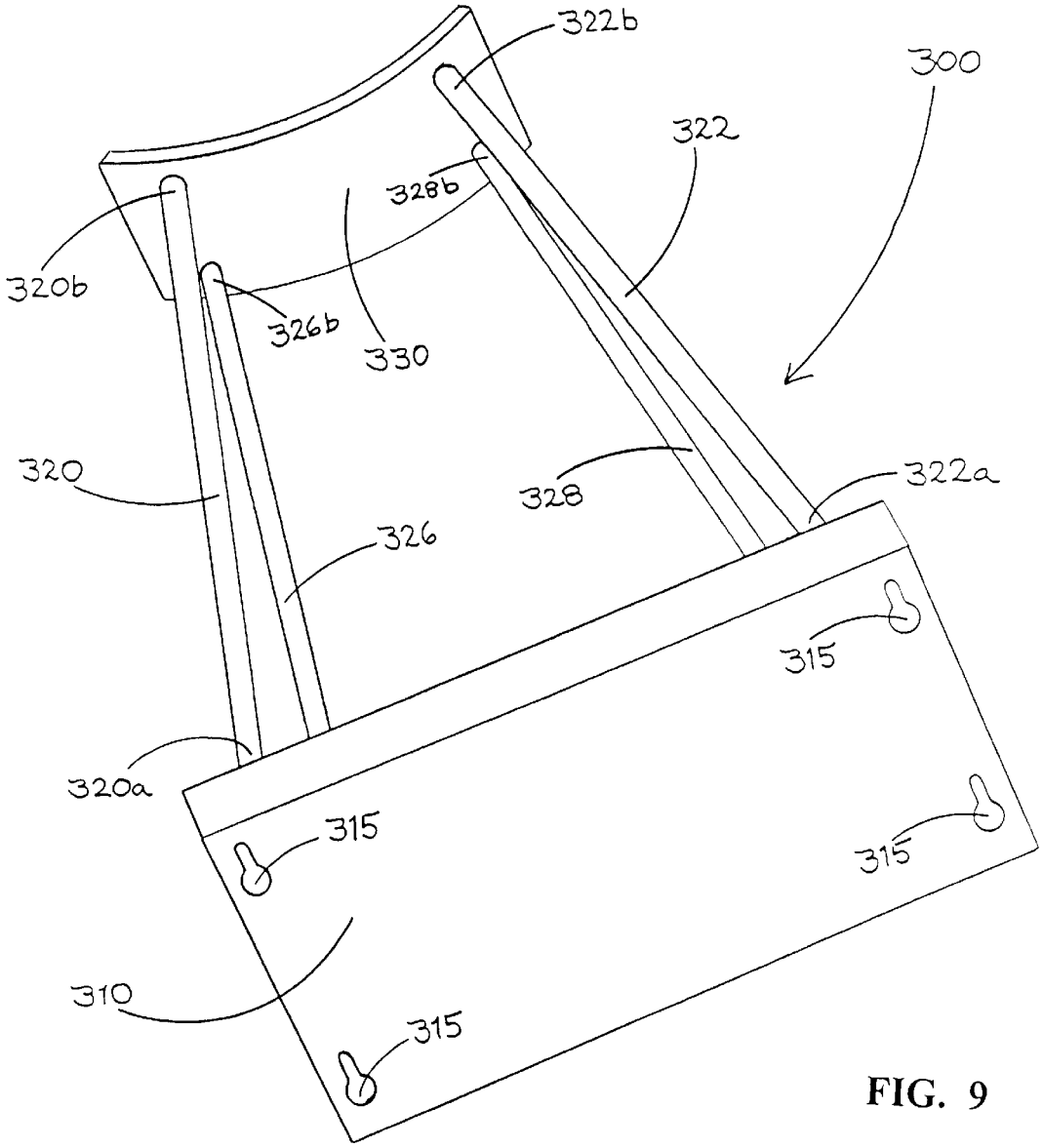
FIG. 9 is a perspective view of an example of a wall bracket for use with the preferred embodiment.
Figure 11:
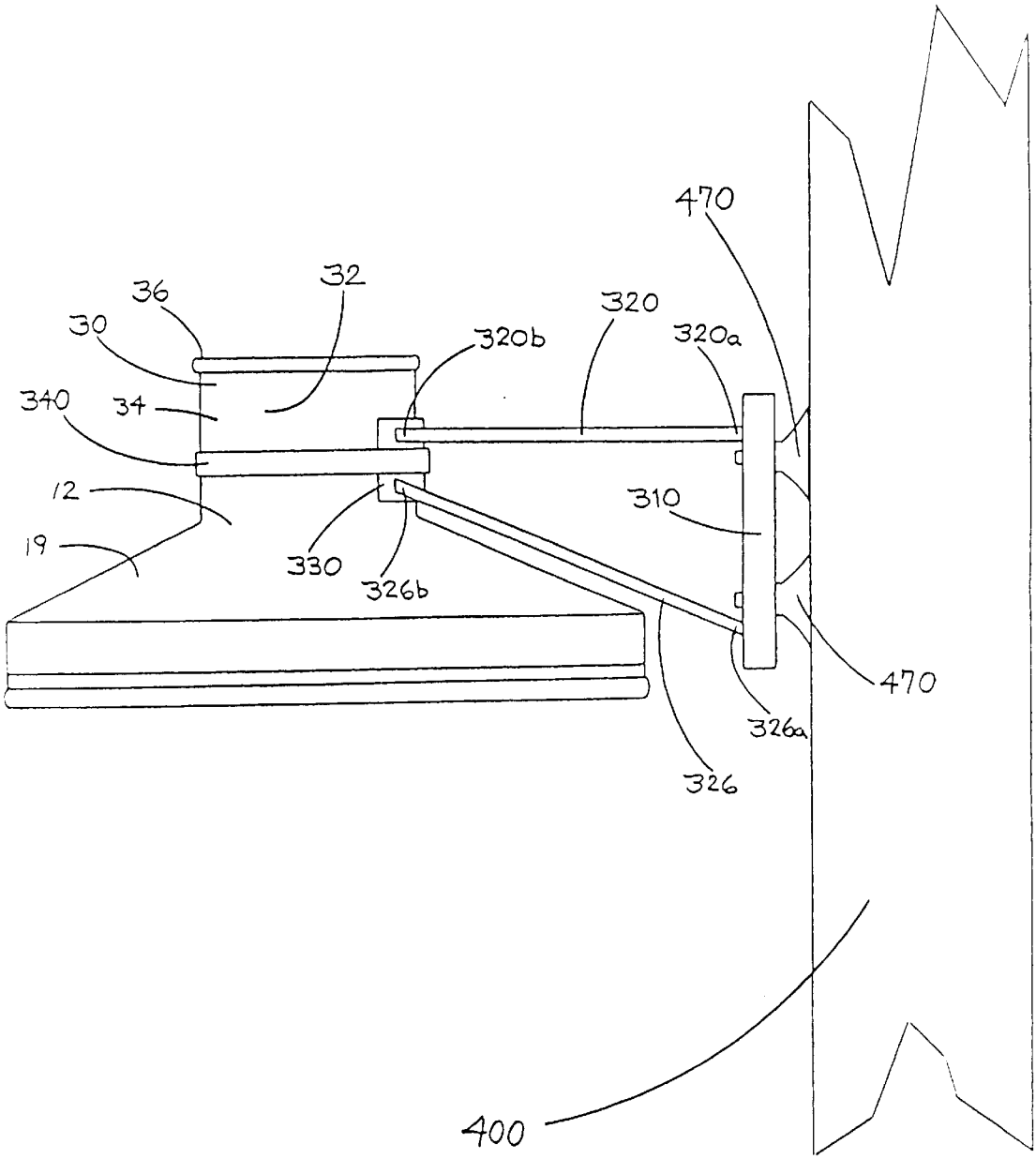
FIG. 11 is a side view of the preferred embodiment using a wall bracket of the general type in FIGS. 7 through 11 wherein the wall bracket is secured to a surface using suction cups instead of screws, nails or other, more permanent fasteners.

As illustrated in FIG. 9, wall bracket 300 includes a mounting plate 310. Mounting plate 310 is adapted for attachment to a substantially vertical surface 400 such as a wall. Screw holes 315 are provided through plate 310 for the insertion of screws to be threaded into surface 400. Screw holes 315 may be slotted as shown in FIG. 9 to facilitate ease of removal and relocation of wall bracket 300. Extending substantially perpendicularly outward from mounting plate 310 is a pair of primary support arms 320 and 322 which extend from their base ends 320*a* and 322*a* at mounting plate 310 to their distal ends 320*b* and 322*b*, respectively. For additional structural integrity, a pair of secondary support arms 326 and 328 may be provided which secondary support arms 326 and 328 extend from their base ends 326*a* and 328*a* to their distal ends 326*b* and 328*b*. Attached to the distal ends 320*b*, 322*b*, 326*b* and 328*b* of arms 320, 322, 326, and 328 is arcuate receiving plate 330. Arcuate receiving plate 330 is adapted to receive and conform with outer surface 34 of chute side wall 32. As such, arcuate receiving plate 330 should have the same radius of curvature as outer surface 34 of chute side wall 32. To secure chute 30 to arcuate receiving plate 330, band clamp 340 is provided. Band clamp 340 may be a commonly available hose clamp the size of which is adjustable with a screwdriver or wrench. Band clamp 340 should be capable of being opened so that it can be fed between primary support arms 320 and 322 and secondary support arms 326 and 328, wrapped around outer surface 34 of chute side wall 32 and then closed and tightened as illustrated in FIGS. 7,8 and 11. Other types of band clamps, indeed entirely different support structures, may be employed to support apparatus 10 above the ground or floor and the preceding description suggests only one method and mechanism for doing so.

In addition to wall bracket 300 having a mounting plate which may be secured by screws to a substantially vertical surface 400, the inventor has contemplated and illustrated a wall bracket 300 which may be secured to a surface 400 with suction cups 470. No further explanation is provided for this alternative, it being manifestly clear how this arrangement might be constructed and utilized.

Where apparatus 10 is used in combination with a substantially rigid, free-standing receptacle 220, apparatus 10 is secured to receptacle 220 and maintained in place by gravity and friction, just as the lid sold with the receptacle would be. However, where a non-rigid receptacle 240 is used in combination with apparatus 10, a receptacle securing means must be provided for securing receptacle 200 to housing 12 of apparatus 10. The preferred means is provided by band fastener 600. Band fastener 600 fits around side wall outer surface 15 of housing side wall 13 and is expandable and contractible so that it may be removed from outer surface 15 and tightened therearound. Fasteners of this type are sufficiently common to obviate the need for a detailed explanation of band fastener 600. To use band fastener 600 to secure a non-rigid receptacle 240 in place below housing 12, band fastener 600 is loosened, receptacle 240 is placed over side wall outer surface 15 of housing side wall 13, and band fastener 600 is position over receptacle 240 so that receptacle 240 is between side wall outer surface 15 and band fastener 600. Band fastener 600 is positioned then tightened to support receptacle 240 and also to create a substantially air tight seal between receptacle 240 and side wall outer surface 15 to prevent odors originating in receptacle 240 from escaping through the seal between receptacle 240 and outer wall surface 15. To facilitate the proper positioning of band fastener 600 and receptacle 240 around side wall outer surface 15 and to help prevent the slipping off of receptacle 240 as it is filled with returnables, a receptacle fastening lip 16 is provided around the entire length of side wall outer surface 15, below the portion of side wall outer surface around which fastener 600 is tightened, and is preferably integrally molded with side wall 13.

The foregoing is considered to be illustrative only of the principles of the invention. Furthermore, since numerous modifications and changes will readily occur to those skilled in the art, it is not desired that the foregoing limit the invention to the exact construction and operation shown and described. Accordingly, all suitable modifications and equivalents may be resorted to that appropriately fall within the scope of the invention. Other embodiments therefore will occur to those skilled in the art and are within the scope of the following claims:

What is claimed is:

1. An apparatus for counting recyclable returnables comprising:

a housing having a returnable-receiving opening therethrough for receiving returnable items for deposit into a receptacle located below said opening;

a trap door lever pivotally attached to said housing, said trap door lever being pivotable between a first, obstructing position and a second, non-obstructing position, said first, obstructing position being such that said trap door lever forms a substantially air-tight seal with said returnable-receiving opening to prevent the escape of odors originating within the receptacle and so that returnable items received through said opening must strike and displace said trap door lever into said second, non-obstructing position, said second, non-obstructing position being such that returnable items may pass by said trap door lever for deposit into the receptacle;

lever biasing means communicating with said trap door lever for biasing said trap door lever into its first, obstructing position;

a counting meter with a numeric display attached to said housing for registering and displaying one of the number of occasions on which said trap door lever is displaced into its second, non-obstructing position and the number of occasions on which said trap door lever is displaced to its first, obstructing position from its second, non-obstructing position; and meter drive means connecting said trap door lever and said counting meter so that on each occasion in which said trap door lever is displaced into one of its second, non-obstructing position and its first, obstructing position from its second, non-obstructing position, such displacement is registered by said meter and indicated on said numeric display.

2. The apparatus of claim 1 wherein said housing further includes a side wall with at least one of (i) a substantially vertical side wall inner surface, said inner surface being adapted for placement over and removable engagement with the outer perimeter of the open top of a substantially rigid, free-standing returnable receptacle, the receptacle serving to support said apparatus above said receptacle and (ii) a side wall outer surface to which may be removably attached a non-rigid, non-free-standing receptacle.

3. An apparatus for counting recyclable returnables comprising:

a housing including a top wall having top wall inner and outer surfaces and a returnable-receiving opening therethrough for receiving returnables for deposit into a receptacle located below said opening;

a lever mount attached to said top wall inner surface, said mount including at least one mount anchor and a pivot axis connected to and extending from said mount anchor;

a trap door lever pivotally attached to and pivotable about said pivot axis between a first, obstructing position and a second, non-obstructing position, said first, obstructing position being such that said trap door lever forms a substantially air-tight seal with said returnable-receiving opening to prevent the escape of odors originating within the receptacle and so that returnables received through said opening must strike and displace said trap door lever into said second, non-obstructing position, said second, non-obstructing position being such that returnables may pass by said trap door lever for deposit into the receptacle;

lever biasing means communicating with said trap door lever for biasing said trap door lever into its first, obstructing position;

a counting meter with a numeric display attached to said housing for registering and displaying one of the number of occasions on which said trap door lever is displaced into its second, non-obstructing position and the number of occasions on which said trap door lever is displaced to its first, obstructing position from its second, non-obstructing position; and meter drive means connecting said trap door lever and said counting meter so that on each occasion in which said trap door lever is displaced into one of its second, non-obstructing position and its first, obstructing position from its second, non-obstructing position, such displacement is registered by said meter and indicated on said numeric display.

4. The apparatus of claim 3 wherein said meter includes a depressable, reciprocable advance button which, when depressed, causes the read out on said numeric display to advance.

5. The apparatus of claim 4 wherein said trap door lever is attached to a lever rocker arm which lever rocker arm is in turn pivotally attached to said pivot axis and wherein said meter drives means comprises a rocker arm coupling element fixedly attached to and extending from said rocker arm to a coupling end and a meter arm which meter arm has a first end and a second end; said meter arm being pivotally attached at its first end to said coupling end of said coupling element and attached at its second end to said depressable, reciprocal advance button so that when said trap door lever is displaced into one of its second, non-obstructing position and its first, obstructing position, said coupling element pivots about said pivot axis in tandem with said trap door lever thereby moving said meter arm to depress said advance button of said meter.

6. The apparatus of claim 3 wherein said housing further includes a side wall with a substantially vertical side wall inner surface, said inner surface being adapted for placement over and removable engagement with the outer perimeter of the open top of a substantially rigid, free-standing returnable receptacle, the receptacle serving to support said apparatus above said receptacle.

7. The apparatus of claim 6 wherein the removable engagement between said inner surface and the outer perimeter of the open top of the substantially rigid, free-standing receptacle is substantially air-tight so that odors originating from returnables within the receptacle are prevented from escaping through said opening.

8. The apparatus of claim 3 wherein said housing further includes a side wall with a side wall outer surface to which may be removably attached a non-rigid, non-free-standing receptacle with a receptacle securing means.

9. The apparatus of claim 8 further including support means for supporting said housing above a surface.

10. An apparatus for counting recyclable returnables comprising:

a housing including a top wall having top wall inner and outer surfaces and a substantially vertical returnable-receiving chute, said chute including a side wall having inner and outer side wall surfaces, an open top end, and a returnable-receiving opening, said returnable-receiving opening being located below said inner surface of said top wall and opposite said open top end for receiving returnable items for deposit into a receptacle located below said opening;

a lever mount attached to said outer surface of said side wall of said chute between said inner surface of said top wall and said returnable-receiving opening, said mount including at least one mount anchor and a pivot axis connected to and extending from said mount anchor;

a trap door lever pivotally attached to and pivotable about said pivot axis between a first, obstructing position and a second, non-obstructing position, said first, obstructing position being such that said trap door lever forms a substantially air-tight seal with said returnable-receiving opening to prevent the escape of odors originating within the receptacle and so that returnables received through said opening must strike and displace said trap door lever into said second, non-obstructing position, said second, non-obstructing position being such that returnables may pass by said trap door lever for deposit into the receptacle;

lever biasing means communicating with said trap door lever for biasing said trap door lever into its first, obstructing position;

a counting meter with a numeric display attached to said housing for registering and displaying one of the number of occasions on which said trap door lever is displaced into its second, non-obstructing position and the number of occasions on which said trap door lever is displaced to its first, obstructing position from its second, non-obstructing position; and meter drive means connecting said trap door lever and said counting meter so that on each occasion in which said trap door lever is displaced into one of its second, non-obstructing position and its first, obstructing position from its second, non-obstructing position, such displacement is registered by said meter and indicated on said numeric display.

11. The apparatus of claim 10 wherein said meter includes a depressable, reciprocable advance button which, when depressed, causes the read out on said numeric display to advance.

12. The apparatus of claim 11 wherein said trap door lever is attached to a lever rocker arm which lever rocker arm is in turn pivotally attached to said pivot axis and wherein said meter drives means comprises a rocker arm coupling element fixedly attached to and extending from said rocker arm to a coupling end and a meter arm which meter arm has a first end and a second end; said meter arm being pivotally attached at its first end to said coupling end of said coupling element and attached at it second end to said depressable, reciprocal advance button so that when said lever is displaced into one of its second, non-obstructing position and its first, obstructing position, said coupling element pivots about said pivot axis in tandem with said lever thereby moving said meter arm to depress said advance button of said meter.

13. The apparatus of claim 12 wherein said lever biasing means comprises a torsion spring anchored at at least one end to one of said mount anchor and said rocker arm and, at its opposite end, at least bearing against the other of said rocker arm and said mount anchor.

14. The apparatus of claim 10 wherein said housing further includes a side wall with a substantially vertical side wall inner surface, said inner surface being adapted for placement over and removable engagement with the outer perimeter of the open top of a substantially rigid, free-standing returnable receptacle, the receptacle serving to support said apparatus above said receptacle.

15. The apparatus of claim 14 wherein the removable engagement between said inner surface and the outer perimeter of the open top of the substantially rigid, free-standing receptacle is substantially air-tight so that odors originating from returnables within the receptacle are prevented from escaping through said opening.

16. The apparatus of claim 10 wherein said housing further includes a side wall with a side wall outer surface to which may be removably attached a non-rigid, non-free-standing receptacle using a receptacle securing means.

17. The apparatus of claim 16 wherein said receptacle securing means is a band fastener which can be tightened and loosened for alternate engagement and disengagement with said outer surface; the receptacle being located between said outer surface and said band fastener and supported thereby in substantially air-tight engagement with said outer surface so that odors originating from returnables within the receptacle are prevented from between the receptacle and said side wall outer surface.

18. The apparatus of claim 16 further including support means for supporting said housing above a surface.

19. The apparatus of 18 wherein said support means is a bracket attached to said housing which bracket is securable to a substantially vertical surface.

* * * * *

UNITED STATES PATENT AND TRADEMARK OFFICE

CERTIFICATE OF CORRECTION

PATENT NO. : 6,050,485
DATED : April 18, 2000
INVENTOR(S) : Darryl E. Brito

It is certified that error appears in the above-identified patent and that said Letters Patent is hereby corrected as shown below:

Delete spec. columns 1-12, and substitute the attached spec.

Signed and Sealed this

Third Day of September, 2002

*Attest:*

*Attesting Officer*

JAMES E. ROGAN
*Director of the United States Patent and Trademark Office*

APPARATUS FOR COUNTING RECYCLABLE RETURNABLE ITEM HAVING AN AIR TIGHT TRAP DOOR MECHANISM

FIELD OF THE INVENTION

This invention relates generally to the collection and redemption of recyclable cans and bottles, and more particularly to an apparatus which tallies and displays the total number of recyclable items deposited into a receptacle.

BACKGROUND

The recycling of cans, bottles, paper, plastic, cardboard and other items has steadily increased over the past 20 to 30 years. Many states encourage the recycling of such items, particularly beverage containers, by requiring the consumer to pay a container deposit at the time of purchase. These deposits are returned to the consumer when the container is returned to a redemption center. Some states require the recycling of such items by law without the incentive provided by the container deposit system in force in many states.

It is a reasonable proposition that the bulk of items sold in so called returnable containers are sold to consumers for use in the home. It has become common place for members of households to collect, separate, count and return these returnable containers to receive the return of the deposit paid at the time of purchase. Common methods of carrying out this task include providing separate receptacles for cans, plastic bottles, and glass bottles. Sometimes separate receptacles are even provided for glass bottles according to the color of the glass: green, brown or clear, for example. It is also reasonable to suppose that most persons do not derive pleasure from performing this time consuming task; most view it as their duty to help preserve the environment or as a means of cutting costs by receiving the return of the container deposit or both. When returnable containers are brought to redemption centers, it is often the responsibility of the consumer to know the quantity of items being returned. Even in those instances where this is not the case, such as when returnables are deposited into centrally located machines which receive, count, and compress the returnable containers, and then release the corresponding amount of money to the consumer, most persons tend to count their returnables before making the trip to redeem their containers.

The instant invention provides an apparatus which registers, tallies, and displays the total number of returnables entered into a receptacle for redemption and thereby eliminates the need for consumers to do so manually. For the purpose of this specification and the claims, all items such as cans, bottles, and other containers which this device is intended to count are referred to collectively as "returnables."

SUMMARY

It is the principal object of this invention to provide an apparatus which registers, tallies, and displays the total number of returnables deposited into a receptacle for redemption.

It is a further object of this invention, by its performance of the principal object, to eliminate much of the displeasure of collecting and redeeming returnable containers by obviating the need for consumers to manually count the same, and even to introduce an element of fun and entertainment into the task.

It is still an additional object of the present invention to further encourage persons to recycle their returnable containers to protect and preserve the environment by rendering the job easier and more pleasurable.

The above and other objects are achieved by the present invention which, according to one embodiment provides a housing having a returnable-receiving opening therein through which returnables are to be deposited into a receptacle disposed below the housing. The housing may be of any shape, but certain shapes are more advantageous than others. If the receptacle to be positioned below the housing is a standard kitchen or other garbage can, then a housing shaped to cover the open top of such a garbage can in the same manner the garbage can's own lid would is most desirable. If, however, the receptacle is to be a non-rigid structure such as a plastic garbage bag, then the housing will preferably have a perimeter which is substantially circular in shape to which the plastic garbage bag may be fastened in substantially air-tight fashion. In cases in which a non-rigid receptacle is to be used in combination with the device, the device cannot depend for its support above the floor or ground on the receptacle into which returnables are to be deposited; therefore, a means for elevating the housing over the receptacle must be provided and could include a free-standing framework which would allow the device to be moved to different locations or means for mounting the device to a wall or other structure either permanently or temporarily. The details of some such possible supporting means are reserved for the detailed description.

Pivotally attached to the housing is a lever which is pivotable between a first, obstructing position in which it at least partially obstructs the returnable-receiving opening so that returnables deposited therethrough must strike and displace it, and a second, non-obstructing position in which returnables may pass by the lever and into the receptacle below. Acting on the lever is a means for biasing the lever into its first, obstructing position. Such means may include a torsion spring, a coil spring, a leaf spring, or another resilient or elastic member.

Also disposed on the housing is a counting meter for counting the number of returnable items deposited into the receptacle below. The counting meter registers and displays the total number of occasions on which the lever is displaced to the second, non-obstructing position. The activation of the counting meter to advance the display by "1" each time the lever is displaced is preferably achieved by direct mechanical contact with the lever or mechanical contact through some intermediate linkage, but the use of magnetic, electromagnetic, electromechanical, electrical, electronic, photonic, optoelectronic or other similar means will certainly occur to those of ordinary skill in the art and are deemed to be within the scope of this invention.

When the receptacle is full, or when a predetermined number of returnables has been deposited therein, the housing and the receptacle may be separated, the receptacle emptied or taken away, an empty receptacle joined with the housing, and the counting meter reset to read "0."

The lever is preferably in the form of a trap door which completely covers the returnable-receiving opening when in the first, obstructing position to prevent odors originating from returnables within the receptacle from diffusing to the atmosphere surrounding the device and the receptacle. Furthermore, the preferred counting meter is of the general type that is normally activated by one's thumb or finger and that is commonly available. These devices generally have a depressable button, a digital or other numeric display which displays the number of times the button has been depressed, and a reset button to bring the display reading back to zero. The counting meter is mounted onto the housing in a position that makes its display conveniently readable and its reset button reasonably accessible. The counting meter is also mounted in a location that facilitates simplicity in mechanically linking it to the lever such that the moving of the lever into its second, non-obstructing position causes the depression or activation of the button on the counting meter and permits that button to return to its normally non-depressed position each time the lever returns to its first, obstructing position.

Other objects, features, advantages and uses of this invention will occur to those skilled in the art and others from the following description of a preferred embodiment and the accompanying drawings.

BRIEF DESCRIPTION OF THE DRAWINGS

Figure 4:
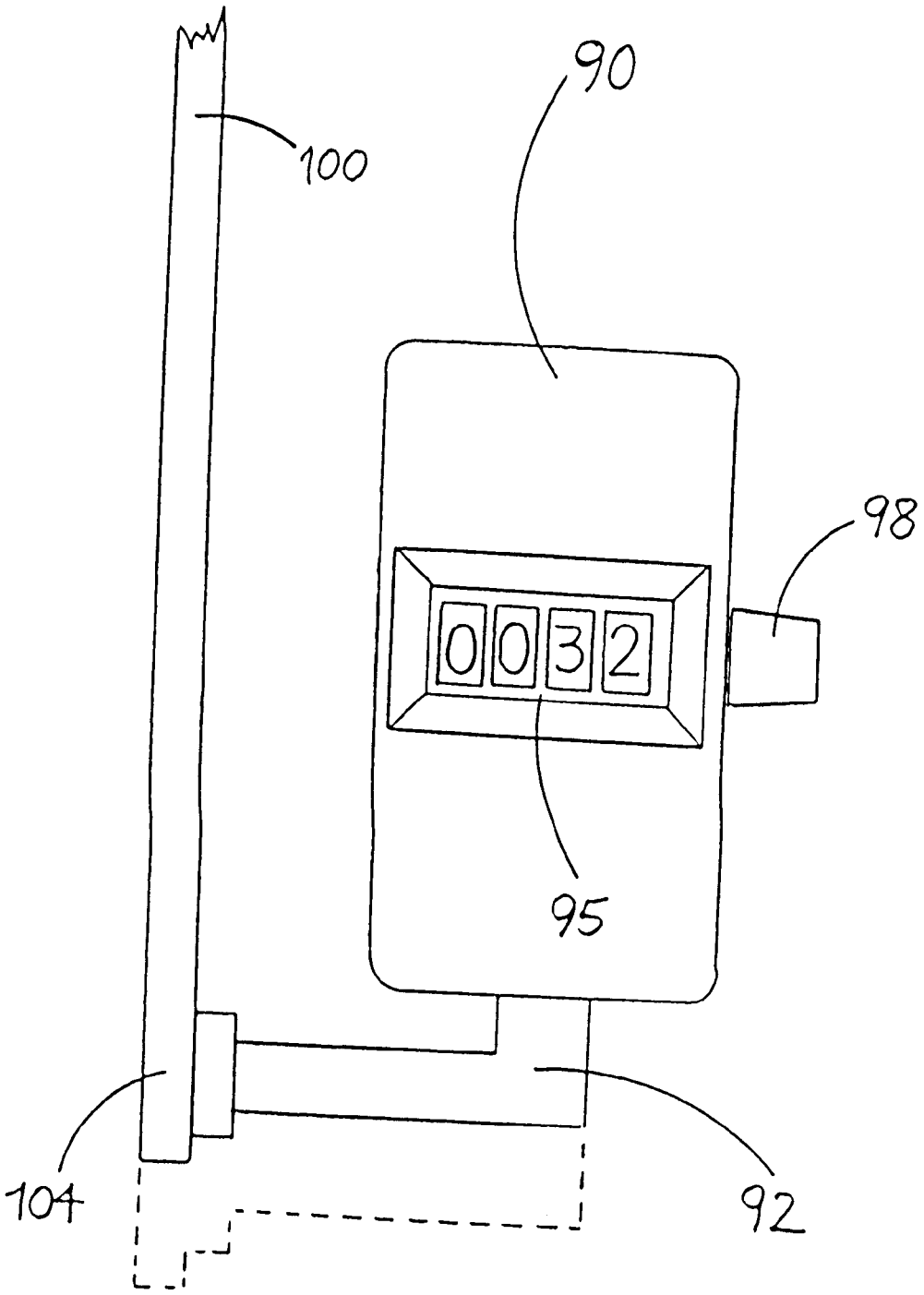
FIG. 4 is a front view of a counting meter of the type to be used in the preferred embodiment.
Figure 10:
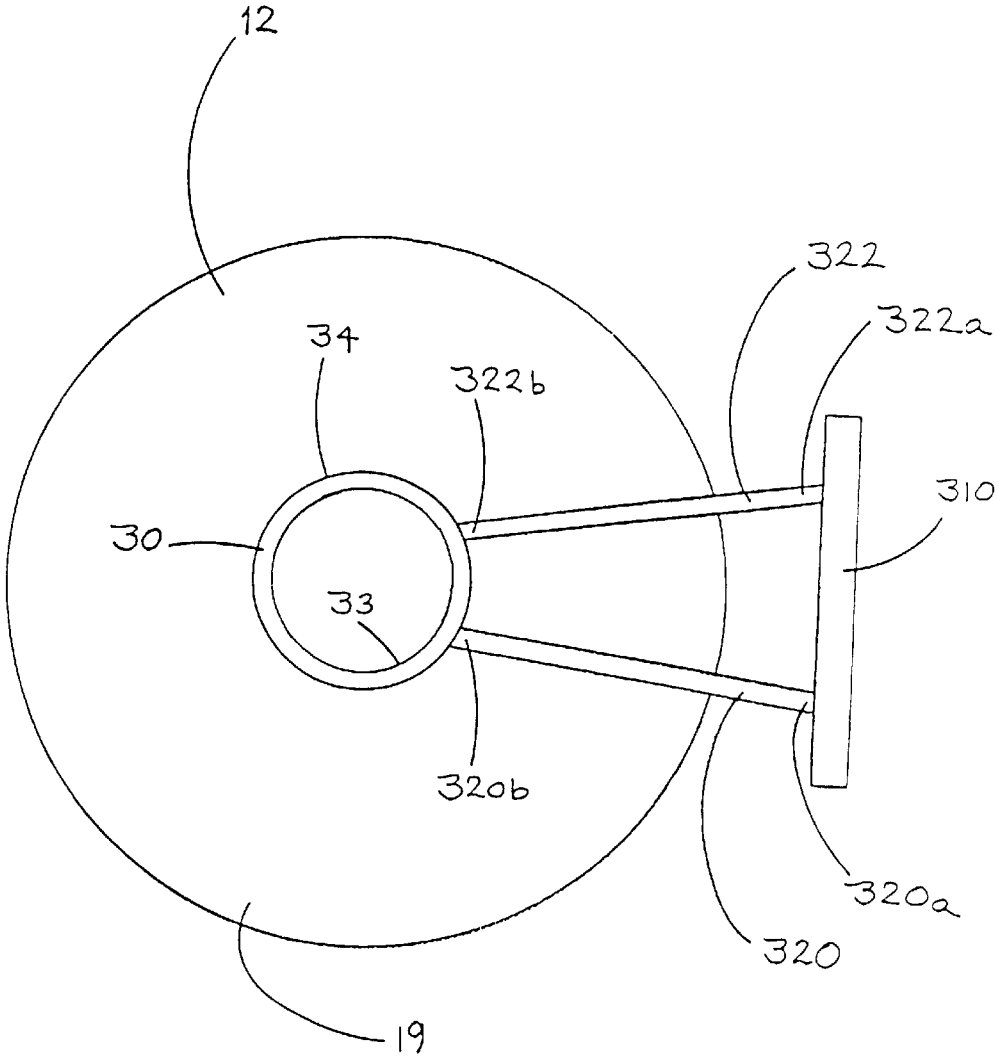
FIG. 10 shows a top view of the preferred embodiment of the invention mounted to a wall using the wall bracket illustrated in FIGS. 7 through 9.

FIG. 1 is a side view of the exterior portion of the housing of an embodiment;

FIG. 2 shows a partial cutaway side view of the housing illustrating details of components disposed in the embodiment of FIG. 1;

FIG. 3 is a bottom view of the trap door lever and returnable-receiving chute of the embodiment illustrated in FIG. 1, and shows details of how the trap door lever is pivotally mounted to the housing and biased into a first, obstructing (closed) position;

FIG. 4 is a front view of the counting meter shown in FIG. 3;

FIG. 5 is a top perspective view of the trap-door-lever rocker arm used to pivotally attach the trap door lever to the housing in the embodiment of FIGS. 1 through 4;

FIG. 6 illustrates a side view of the embodiment of FIG. 1 mounted on, and supported by, a rigid, free standing returnable-item receptacle such as a garbage can;

FIG. 7 illustrates a side view of the embodiment of FIG. 1 secured to a wall with a wall bracket;

FIG. 8 illustrates a side view of the embodiment of FIG. 7 supporting a non-rigid returnable-item receptacle such as a plastic garbage bag;

FIG. 9 is a perspective view of the wall bracket shown in FIGS. 8 and 9;

FIG. 10 shows a top view of the embodiment of FIGS. 7 and 8;

FIG. 11 is a side view of an embodiment supported by a wall bracket secured to a surface by suction cups; and FIG. 12 is a partial cutaway side view of an embodiment having a housing like that of the embodiment of FIGS. 1 and 2 wherein the internal components are alternatively arranged.

DETAILED DESCRIPTION

There is shown in FIGS. 1 through 12 an apparatus for counting recyclable returnable items 10. The apparatus 10 comprises a housing 12 having a side wall 13, which has an inner surface 14 and an outer surface 15, and a top wall 17, which has an inner surface 18 and an outer surface 19. Included in the housing 12, and extending through the top wall 17 thereof, is a returnable-receiving chute 30. The returnable receiving chute 30 has a chute side wall 32 and extends downwardly from an open top end 36 to a returnable receiving opening 38. The chute side wall 32 has inner and outer surfaces 33 and 34, respectively.

In the embodiments shown, the chute 30 extends above the top wall 19 by an amount sufficient to permit its being grasped by a user to serve as a handle. In those instances in which the top wall 19 is sloped downwardly as it extends outwardly, as illustrated in FIGS. 1,2, 6–8, 11, and 12, the chute 30 preferably extends below the area in which it is joined with the top wall 19 to a depth sufficient to accommodate components to be described further in this description.

Mounted to or integrally molded with the housing 12, preferably on a portion of the outer surface 34 of the chute side wall 32 which extends below the top wall inner surface 18 by an amount sufficient to accommodate the same, is trap door lever mount 50. The trap door lever mount 50 shown in FIG. 3 comprises a pair of substantially parallel, spaced apart mount anchors; specifically, a right-hand mount anchor 52 and a left-hand mount anchor 54. To add stability and durability, an anchor stabilizer 55 may extend between, and be fixedly attached to or integrally molded with, the mount anchors 52 and 54. Extending substantially perpendicularly from and between the mount anchors 52 and 54 is a rocker arm pivot axis 58. For reasons that will become apparent, it is preferable but not essential that the pivot axis 58 be fixed with respect to the mount anchors 52 and 54. Furthermore, to facilitate ease of manufacture and to conserve material, the rocker arm pivot axis 58 could be designed to be one in the same with the anchor stabilizer 55. FIG. 12 illustrates a configuration, with the same components, wherein the lever mount 50 is attached to, and downwardly extends from, the top wall inner surface 18.

Pivotally disposed on the rocker arm pivot axis 58 is a trap-door-lever rocker arm 60 (FIGS. 2,3, and 5). Attached to or integrally molded with the rocker arm 60 is a trap door lever 70. The trap door lever 70 has a top surface 72 and a bottom surface 74. To provide strength and durability, the rocker arm 60 may comprise two fingers, a right-hand finger 62 and a left-hand finger 64, extending from points of pivotal attachment to the rocker arm pivot axis 58 to distal end points of attachment with the bottom surface 74. In any event, the rocker arm 60 has at least one finger 62 or 64 extending from a point of pivotal attachment to the pivot axis 58 to a distal end which is attached to the lever 70. Similar to the lever mount 50, the fingers 62 and 64 of the rocker arm 60 in the embodiment shown are joined by a rocker arm stabilizer 66. The rocker arm stabilizer 66 ensures that a fixed distance between the fingers 62 and 64 is maintained and assists in preventing the fingers 62 and 64 from pivoting about the pivot axis 58 independently of one another which could cause the trap door lever 70 to deviate from its intended path of motion, a consequence the undesirability of which will become apparent below.

Trap door lever 70 is of a size and shape to completely cover the returnable-receiving opening 38 and is pivotable about the pivot axis 58 between a first, obstructing position in which it closes off the returnable-receiving opening 38 and a second, non-obstructing position in which returnables may pass through the returnable-receiving opening 38 and into a receptacle 200 located below the housing 12. Trap door lever biasing means are provided for urging the trap door lever 70 into its first, obstructing position. The preferred mechanism to facilitate these biasing means is a torsion spring 68 which is anchored at one end to either the pivot axis 58 or the rocker arm 60 and, at its other end, bears against the other of the rocker arm 60 and the pivot axis 58. Of course any number of mechanisms could be employed to urge the trap door lever 70 into its first obstructing position including a coil spring, a leaf spring, an elastic or resilient member, magnets or even a counter weight disposed at or near the rocker arm stabilizer 66, for example, and all such alternatives and their functional equivalents are regarded as within the scope and contemplation of this invention.

Because returnables, even when they are washed out before storing for redemption, can sometimes be the source of disagreeable odors, it is desirable that the contact between the trap door lever 70 and that portion of the chute side wall 32 defining the returnable-receiving opening 38 be as close to air tight as possible. To facilitate this feature, a resilient gasket 39 may be attached to the chute side wall 32 at the perimeter of the returnable-receiving opening 38.

As stated in the summary of the invention, it is the displacement of the trap door lever 70 between its first, obstructing position and its second, non-obstructing position which is to be detected and registered. To accomplish this objective, a counting meter 90 is provided. The counting meter 90 is preferably mechanical in nature. More particularly, the meter 90 preferably has an advance button 92, a numeric display 95, and a reset button 98. Counting meters of this general type are so well known in and out of the art to which this invention pertains that explanations as to the functions of the advance button 92, the numeric display 95, and the reset button 98 is all that is required for a full appreciation of the metering aspect of the invention. The numeric display 95 indicates the number of times the advance button 92 has been depressed or activated since the last occasion on which the reset button 98 was activated to return the display 95 to a reading of "0." Each time the advance button 92 is activated, the display advances the total count displayed by the value "1."

The counting meter 90 is preferably removably mounted to the top wall inner surface 18 of the housing 12 via a meter mount 97 so that its numeric display 95 faces generally upward and is visible through a display window 99 provided in the housing top wall 17. Removability of the meter 90 is desirable in the event the meter 90 should cease functioning; replacement of the meter 90 is all that would be required as opposed to replacement of the entire apparatus 10.

Turning now to the illustrated meter drive means connecting the counting meter 90 to the trap door lever 70 such that the movement of the latter into its second, non-obstructing position causes the meter 90 to register and indicate the occurrence of the event, extending generally upward from the rocker arm 60, and attached to or integral therewith, is a rocker arm coupling element 67 (FIGS. 2 and 5). The rocker arm coupling element 67 extends from its point of connection with the rocker arm 60 to a coupling end 69. The coupling element 67 moves rotationally about the pivot axis 58 in tandem with the remainder of the rocker arm 60. In accordance with basic geometric principles, the longer the coupling element 67 is, the greater the arcuate distance its coupling end 69 will travel for any given angular displacement about the pivot axis 58. Pivotally attached to the coupling element 67, adjacent its coupling end 69, is a meter arm 100, as illustrated in FIG. 1. The meter arm 100 has a first end 102 and a second end 104 and is joined with the coupling element 69 at its first end 102 by a pivot pin 105. At its second end 104, the meter arm 100 is attached to the advance button 92. Depending on the length and flexibility of the meter arm 100, the junction between its second end 104 and the button 92 may also have to be pivotal; this point is also dictated by simple geometric and engineering principles and therefore requires no further explanation.

It warrants stating that the mechanical details of the particular meter drive means described herein is only a single example of numerous mechanical variations capable of achieving the same result, and that such alternatives will no doubt occur to those of ordinary skill in the art to which this invention pertains and are regarded as within the scope of this invention. Rotational ratcheting systems of the type used in pendulum driven clocks come to mind as one specific alternative. The essential feature of the meter and its drive means is that it respond to at least a portion of one cycle of motion of the trap door lever 70 by counting and displaying the occurrence of the event. What is meant by a cycle of motion is the action of the trap door lever 70 moving from its first, obstructing position to its second, non-obstructing position and back again to its original obstructing position. While the registering and displaying of the occurrence of this motion in the description above has focused on the first half of the cycle (i.e., the lever 70 moving from its first to its second position), there is no reason why the drive means cannot be arranged such that the return of the lever 70 from its second to its first position is what is registered and displayed. However, the preferred choice of which motion to register was not entirely arbitrary with this inventor because, with the arrangement chosen, the meter 90 will still register the deposit of a returnable item even if the lever 70 should for some reason remain stuck in its second, non-obstructing position after the deposit of a returnable through the apparatus 10. The opposite arrangement requires the return of the lever 70 to its first position to register the deposit.

As stated in the summary, the apparatus 10 may be adapted for use with any type receptacle such as a substantially rigid, free standing receptacle 220 like a garbage can or a non-rigid receptacle 240 requiring independent support such as a plastic or paper bag. In those instances when the apparatus 10 is to be used in combination with a rigid, free standing receptacle 220, the housing 12 can be constructed to fit over the upper rim 222 of such a receptacle in the same manner a garbage can's own lid would as shown in FIG. 6. In such circumstances, the side wall inner surface 14 of the housing side wall 13 would have to be substantially vertical for placement over and removable engagement with the outer perimeter 226 of the upper rim defining the open top 228 of the receptacle 220. Furthermore, it is preferable that the removable engagement between the side wall inner surface 14 and the outer perimeter 226 of the upper rim 222 of the receptacle 220 be substantially air-tight so that odors originating from returnables within the receptacle 220 are prevented from escaping through the open top 228 of the receptacle 220 and, more particularly, between the perimeter 226 of the upper rim 222 and the side wall inner surface 14. Such an arrangement is illustrated in FIG. 6 with a cutaway view of a section of each of the housing 10 and the receptacle 220. A substantially rigid receptacle 220 such as that pictured in FIG. 6 serves to support the apparatus 10 in position.

Where non-rigid receptacles such as bags are to be used with the device, an independent support means must be provided to support the apparatus 10 above a surface such as the ground or floor with the non-rigid receptacle 240 disposed thereunder. By way of example, the inventor discloses one such independent support means in the form of a wall bracket 300 illustrated in FIGS. 7 through 11.

As illustrated in FIG. 9, the wall bracket 300 includes a mounting plate 310. The mounting plate 310 is adapted for attachment to a substantially vertical surface 400 such as a wall. Screw holes 315 are provided through the plate 310 for the insertion of screws to be threaded into the surface 400. The screw holes 315 may be slotted as shown in FIG. 9 to facilitate ease of removal and relocation of the wall bracket 300. Extending substantially perpendicularly outward from the mounting plate 310 is a pair of primary support arms 320 and 322 which extend from base ends 320*a* and 322*a* at the mounting plate 310 to distal ends 320*b* and 322*b*, respectively. For additional structural integrity, a pair of secondary support arms 326 and 328 may be provided which secondary support arms 326 and 328 extend from base ends 326*a* and 328*a* to distal ends 326*b* and 328*b*. Attached to the distal ends 320*b*, 322*b*, 326*b* and 328*b* of the arms 320, 322, 326, and 328 is an arcuate receiving plate 330. The arcuate receiving plate 330 is adapted to receive and conform with the outer surface 34 of the chute side wall 32. As such, the arcuate receiving plate 330 should have the same radius of curvature as the outer surface 34 of the chute side wall 32. To secure the chute 30 to the arcuate receiving plate 330, a band clamp 340 is provided. The band clamp 340 may be a commonly available hose clamp the size of which is adjustable with a screwdriver or wrench. The band clamp 340 should be capable opening so that it can be fed between the primary support arms 320 and 322 and the secondary support arms 326 and 328, wrapped around the outer surface 34 of the chute side wall 32 and then closed and tightened as illustrated in FIGS. 7,8 and 11. Other types of band clamps, indeed entirely different support structures, may be employed to support the apparatus 10 above the ground or floor and the preceding description suggests only one method and mechanism for doing so.

In addition to a wall bracket 300 having a mounting plate 310 which may be secured by screws to a substantially vertical surface 400, the inventor has contemplated and illustrated a wall bracket 300 which may be secured to a surface 400 with suction cups 470. No further explanation is provided for this alternative, it being manifestly clear how this arrangement might be constructed and utilized.

Where the apparatus 10 is used in combination with a substantially rigid, free-standing receptacle 220, the apparatus 10 is secured to the receptacle 220 and maintained in place by gravity and friction, just as the lid sold with the receptacle would be. However, where a non-rigid receptacle 240 is used in combination with the apparatus 10, a receptacle securing means must be provided for securing the receptacle 200 to the housing 12 of the apparatus 10. One such means is provided by a band fastener 600. The band fastener 600 fits around the side wall outer surface 15 of the housing side wall 13 and is expandable and contractible so that it may be removed from the outer surface 15 and tightened therearound. Fasteners of this type are sufficiently common to obviate the need for a detailed explanation of the band fastener 600. To use the band fastener 600 to secure a non-rigid receptacle 240 in place below the housing 12, the band fastener 600 is loosened, the receptacle 240 is placed over the side wall outer surface 15 of the housing side wall 13, and the band fastener 600 is position over the receptacle 240 so that the receptacle 240 is between the side wall outer surface 15 and the band fastener 600. The band fastener 600 is positioned then tightened to support the receptacle 240 and also to create a substantially air tight seal between the receptacle 240 and the side wall outer surface 15 to prevent odors originating in the receptacle 240 from escaping through the seal between the receptacle 240 and the outer wall surface 15. To facilitate the proper positioning of the band fastener 600 and the receptacle 240 around the side wall outer surface 15 and to help prevent the slipping off of the receptacle 240 as it is filled with returnables, a receptacle fastening lip 16 is provided around the entire length of the side wall outer surface 15, below the portion of the side wall outer surface 15 around which the fastener 600 is tightened, and is preferably integrally molded with the side wall 13.

The foregoing is considered to be illustrative only of the principles of the invention. Furthermore, since numerous modifications and changes will readily occur to those skilled in the art, it is not desired that the foregoing limit the invention to the exact construction and operation shown and described. Accordingly, all suitable modifications and equivalents may be resorted to that appropriately fall within the scope of the invention. Other embodiments therefore will occur to those skilled in the art and are within the scope of the following claims.

What is claimed is:

1. An apparatus for counting recyclable returnables comprising:

a housing having a returnable-receiving opening therethrough for receiving returnable items for deposit into a receptacle located below said opening;

a trap door lever pivotally attached to said housing, said trap door lever being pivotable between a first, obstructing position and a second, non-obstructing position, said first, obstructing position being such that said trap door lever forms a substantially air-tight seal with said returnable-receiving opening to prevent the escape of odors originating within the receptacle and so that returnable items received through said opening must strike and displace said trap door lever into said second, non-obstructing position, said second, non-obstructing position being such that returnable items may pass by said trap door lever for deposit into the receptacle;

lever biasing means communicating with said trap door lever for biasing said trap door lever into its first, obstructing position;

a counting meter with a numeric display attached to said housing for registering and displaying one of the number of occasions on which said trap door lever is displaced into its second, non-obstructing position and the number of occasions on which said trap door lever is displaced to its first, obstructing position from its second, non-obstructing position; and meter drive means connecting said trap door lever and said counting meter so that on each occasion in which said trap door lever is displaced into one of its second, non-obstructing position and its first, obstructing position from its second, non-obstructing position, such displacement is registered by said meter and indicated on said numeric display.

2. The apparatus of claim 1 wherein said housing further includes a side wall with at least one of (i) a substantially vertical side wall inner surface, said inner surface being adapted for placement over and removable engagement with the outer perimeter of the open top of a substantially rigid, free-standing returnable receptacle, the receptacle serving to support said apparatus above said receptacle and (ii) a side wall outer surface to which may be removably attached a non-rigid, non-free-standing receptacle.

3. An apparatus for counting recyclable returnables comprising:

a housing including a top wall having top wall inner and outer surfaces and a returnable-receiving opening therethrough for receiving returnables for deposit into a receptacle located below said opening;

a lever mount attached to said top wall inner surface, said mount including at least one mount anchor and a pivot axis connected to and extending from said mount anchor;

a trap door lever pivotally attached to and pivotable about said pivot axis between a first, obstructing position and a second, non-obstructing position, said first, obstructing position being such that said trap door lever forms a substantially air-tight seal with said returnable-receiving opening to prevent the escape of odors originating within the receptacle and so that returnables received through said opening must strike and displace said trap door lever into said second, non-obstructing position, said second, non-obstructing position being such that returnables may pass by said trap door lever for deposit into the receptacle;

lever biasing means communicating with said trap door lever for biasing said trap door lever into its first, obstructing position;

a counting meter with a numeric display attached to said housing for registering and displaying one of the number of occasions on which said trap door lever is displaced into its second, non-obstructing position and the number of occasions on which said trap door lever is displaced to its first, obstructing position from its second, non-obstructing position; and meter drive means connecting said trap door lever and said counting meter so that on each occasion in which said trap door lever is displaced into one of its second, non-obstructing position and its first, obstructing position from its second, non-obstructing position, such displacement is registered by said meter and indicated on said numeric display.

4. The apparatus of claim 3 wherein said meter includes a depressable, reciprocable advance button which, when depressed, causes the read out on said numeric display to advance.

5. The apparatus of claim 4 wherein said trap door lever is attached to a lever rocker arm which lever rocker arm is in turn pivotally attached to said pivot axis and wherein said meter drives means comprises a rocker arm coupling element fixedly attached to and extending from said rocker arm to a coupling end and a meter arm which meter arm has a first end and a second end; said meter arm being pivotally attached at its first end to said coupling end of said coupling element and attached at its second end to said depressable, reciprocal advance button so that when said trap door lever is displaced into one of its second, non-obstructing position and its first, obstructing position, said coupling element pivots about said pivot axis in tandem with said trap door lever thereby moving said meter arm to depress said advance button of said meter.

6. The apparatus of claim 3 wherein said housing further includes a side wall with a substantially vertical side wall inner surface, said inner surface being adapted for placement over and removable engagement with the outer perimeter of the open top of a substantially rigid, free-standing returnable receptacle, the receptacle serving to support said apparatus above said receptacle.

7. The apparatus of claim 6 wherein the removable engagement between said inner surface and the outer perimeter of the open top of the substantially rigid, free-standing receptacle is substantially air-tight so that odors originating from returnables within the receptacle are prevented from escaping through said opening.

8. The apparatus of claim 3 wherein said housing further includes a side wall with a side wall outer surface to which may be removably attached a non-rigid, non-free-standing receptacle with a receptacle securing means.

9. The apparatus of claim 8 further including support means for supporting said housing above a surface.

10. An apparatus for counting recyclable returnables comprising:

a housing including a top wall having top wall inner and outer surfaces and a substantially vertical returnable-receiving chute, said chute including a side wall having inner and outer side wall surfaces, an open top end, and a returnable-receiving opening, said returnable-receiving opening being located below said inner surface of said top wall and opposite said open top end for receiving returnable items for deposit into a receptacle located below said opening;

a lever mount attached to said outer surface of said side wall of said chute between said inner surface of said top wall and said returnable-receiving opening, said mount including at least one mount anchor and a pivot axis connected to and extending from said mount anchor;

a trap door lever pivotally attached to and pivotable about said pivot axis between a first, obstructing position and a second, non-obstructing position, said first, obstructing position being such that said trap door lever forms a substantially air-tight seal with said returnable-receiving opening to prevent the escape of odors originating within the receptacle and so that returnables received through said opening must strike and displace said trap door lever into said second, non-obstructing position, said second, non-obstructing position being such that returnables may pass by said trap door lever for deposit into the receptacle;

lever biasing means communicating with said trap door lever for biasing said trap door lever into its first, obstructing position;

a counting meter with a numeric display attached to said housing for registering and displaying one of the number of occasions on which said trap door lever is displaced into its second, non-obstructing position and the number of occasions on which said trap door lever is displaced to its first, obstructing position from its second, non-obstructing position; and meter drive means connecting said trap door lever and said counting meter so that on each occasion in which said trap door lever is displaced into one of its second, non-obstructing position and its first, obstructing position from its second, non-obstructing position, such displacement is registered by said meter and indicated on said numeric display.

11. The apparatus of claim 10 wherein said meter includes a depressable, reciprocable advance button which, when depressed, causes the read out on said numeric display to advance.

12. The apparatus of claim 11 wherein said trap door lever is attached to a lever rocker arm which lever rocker arm is in turn pivotally attached to said pivot axis and wherein said meter drives means comprises a rocker arm coupling element fixedly attached to and extending from said rocker arm to a coupling end and a meter arm which meter arm has a first end and a second end; said meter arm being pivotally attached at its first end to said coupling end of said coupling element and attached at it second end to said depressable, reciprocal advance button so that when said lever is displaced into one of its second, non-obstructing position and its first, obstructing position, said coupling element pivots about said pivot axis in tandem with said lever thereby moving said meter arm to depress said advance button of said meter.

13. The apparatus of claim 12 wherein said lever biasing means comprises a torsion spring anchored at at least one end to one of said mount anchor and said rocker arm and, at its opposite end, at least bearing against the other of said rocker arm and said mount anchor.

14. The apparatus of claim 10 wherein said housing further includes a side wall with a substantially vertical side wall inner surface, said inner surface being adapted for placement over and removable engagement with the outer perimeter of the open top of a substantially rigid, free-standing returnable receptacle, the receptacle serving to support said apparatus above said receptacle.

15. The apparatus of claim 14 wherein the removable engagement between said inner surface and the outer perimeter of the open top of the substantially rigid, free-standing receptacle is substantially air-tight so that odors originating from returnables within the receptacle are prevented from escaping through said opening.

16. The apparatus of claim 10 wherein said housing further includes a side wall with a side wall outer surface to which may be removably attached a non-rigid, non-free-standing receptacle using a receptacle securing means.

17. The apparatus of claim 16 wherein said receptacle securing means is a band fastener which can be tightened and loosened for alternate engagement and disengagement with said outer surface; the receptacle being located between said outer surface and said band fastener and supported thereby in substantially air-tight engagement with said outer surface so that odors originating from returnables within the receptacle are prevented from between the receptacle and said side wall outer surface.

18. The apparatus of claim 16 further including support means for supporting said housing above a surface.

19. The apparatus of 18 wherein said support means is a bracket attached to said housing which bracket is securable to a substantially vertical surface.

* * * * *